United States Patent [19]

Jackson

[11] 3,965,560

[45] June 29, 1976

[54] CORNER KEY MACHINE

[75] Inventor: James Carson Jackson, Baton Rouge, La.

[73] Assignee: James Carson Jackson, Richmond, Va.

[22] Filed: Feb. 3, 1975

[21] Appl. No.: 546,212

[52] U.S. Cl. ..... 29/208 R; 29/208 C; 29/211 R

[51] Int. Cl.[2] ..... B23P 19/04

[58] Field of Search ..... 29/208 R, 208 C, 211 R, 29/200 R

[56] References Cited

UNITED STATES PATENTS

| | | | |
|---|---|---|---|
| 2,075,795 | 4/1937 | Babcock | 29/211 R |
| 2,934,818 | 5/1960 | Challoner et al. | 29/211 R |
| 3,011,248 | 12/1961 | Gilkey | 29/211 R |
| 3,032,866 | 5/1962 | Nathan | 29/208 R |
| 3,241,224 | 3/1966 | Banister et al. | 29/200 R X |

*Primary Examiner*—Victor A. DiPalma
*Attorney, Agent, or Firm*—Donald L. Johnson; John F. Sieberth; Paul H. Leonard

[57] ABSTRACT

A machine or apparatus is provided for automatically inserting a corner key or angle member in an opening in each end of a lineal member or shape, especially an aluminum extrusion for joining mitered corners of a window together. The apparatus comprises a frame, shape or lineal member feed means mounted on the frame for positioning and feeding a lineal shape or member to a location for receiving a corner key, one or more key feed means for positioning and inserting a corner key into one or both ends of the shape or lineal member, and means for operating the lineal member feed means and the key feed means in a desired sequence.

18 Claims, 9 Drawing Figures

CORNER KEY MACHINE

BACKGROUND OF THE INVENTION

In the manufacture and assembly of metal windows, particularly aluminum windows, it is a common practice to use angle members or corner keys to hold the mitered corners of the window frame together. The framing members are designed or constructed so as to have a cavity or opening therein in which a key can be inserted. The keys are designed so that once positioned in the cavity, they cannot be pulled out. One end of a corner key is inserted into each end of both the top and bottom rails (or stiles, if preferred) forming the window frame. After the corner keys are installed in each end of the top and bottom rails, the portions of each key protruding or other end of each key is inserted into openings or cavities in the side or stile members (or rails as the case may be) to provide a complete rectangular frame. Four corner keys are used to hold the rails and stiles together to provide the frame work around a window glass or panel. The corner keys are normally positioned and driven in place by a person using a small hammer.

U.S. Pat. Nos. 3,434,749 and 3,782,054 are illustrative of types of corner keys used in joining mitered metal members together.

It is a primary object of the present invention to provide a machine for automatically inserting a corner key in each end of a shape or lineal member, especially mitered shape, particularly a metal or plastic extrusion having openings in the ends thereof for receiving a corner key.

Another object of the invention is to provide a means for quickly and easily inserting a corner key into a mitered shape or lineal member to be joined with another mitered shape or lineal member.

It is a particular object of the present invention to provide a machine or apparatus for automatically inserting an angle member or corner key in each end of a mitered aluminum extrusion for constructing window frames.

Other objects and advantages of the invention will become more readily apparent from a consideration of the description and drawings hereinafter.

SUMMARY OF THE INVENTION

The present invention relates to a novel machine or apparatus for inserting a corner key in an opening in the end of a shape or lineal member, particularly a metal member, and especially an aluminum extrusion. The novel machine preferably has two key units including two key magazines, one on each end thereof, for insertion of the keys into the shape or lineal member. A key receiving member or shape is selected from the bottom of a stack of shapes positioned in a shape support unit and moved to a stop or position for key insertion by a shape feed unit. The keys are fed from the bottom of the stack of keys in each key magazine and inserted in openings in the lineal member positioned at the stop. All parts of the machine return to their original position and allow a finished lineal part, i.e., one in which the keys have been inserted therein, to drop through the bottom of the machine for collection and further use in completing a framework. The machine cycle repeats as long as shapes or lineal members are positioned in the shape feed unit and keys are in the magazines. The machine is adjustable for various length shapes.

DESCRIPTION OF THE PREFERRED EMBODIMENT

Figure 1:
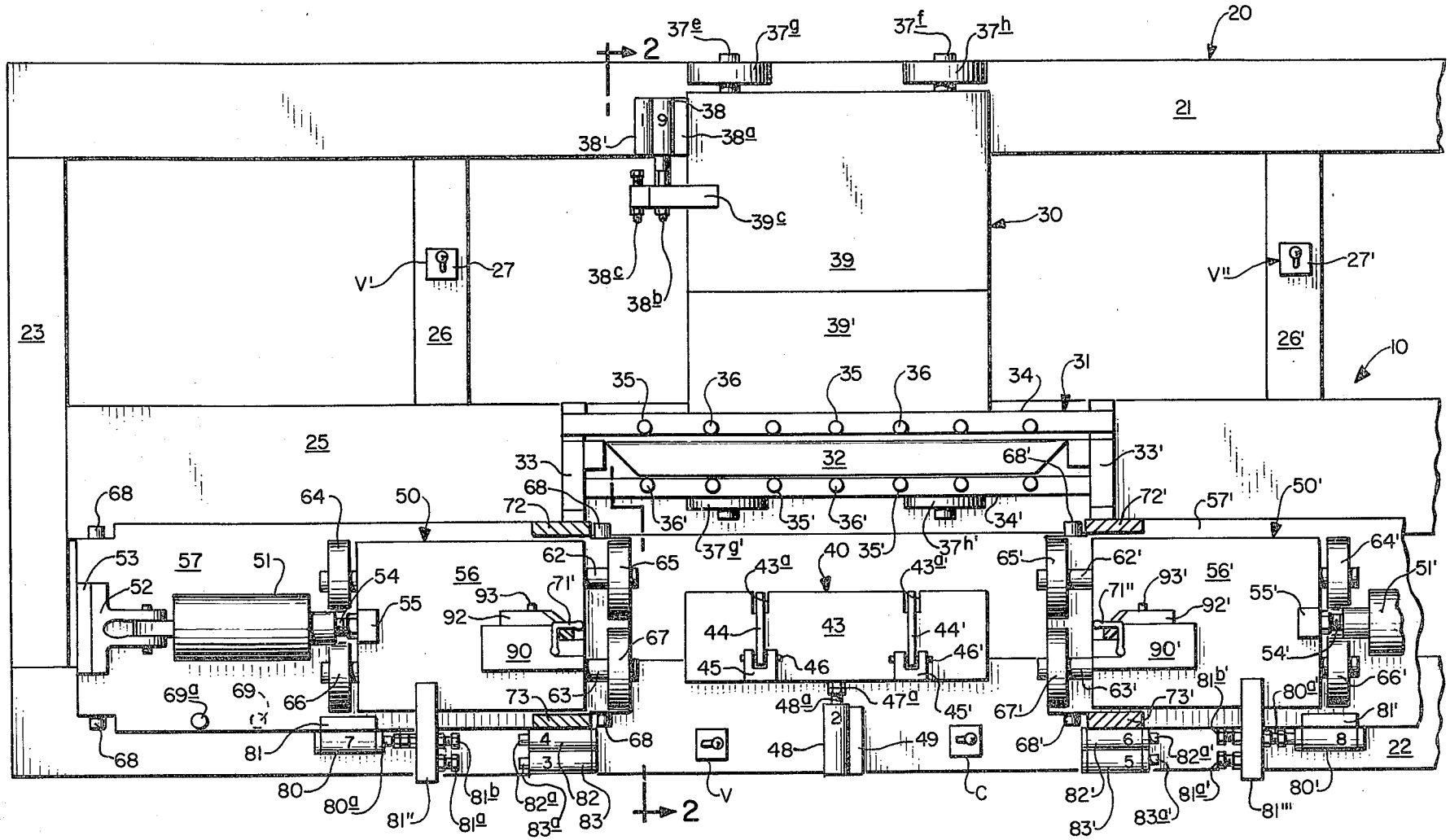
FIG. 1 is a top plan view illustrating the corner key machine of the present invention with a metal member in position in the machine for receiving corner keys.

The corner key machine of the present invention is adapted for use with a one-piece solid corner key or angle member as illustrated in the drawings. It can be appreciated that such machine is readily adaptable for use with other types of angle members or corner keys. The machine is so constructed that two magazines each having a plurality of keys stacked therein, one on top of the other, are placed on each end of an area on the machine wherein a metal shape is held for inserting the keys therein. A key receiving member, such as a mitered aluminum extrusion of a pre-selected length is moved from the bottom of the shape stack to a stop location or position for receiving the keys. The keys are selected from the bottom of the stack of keys in each magazine and inserted in openings in the key receiving members. All parts of the machine are so constructed that they return to their original position and allow a finished part, i.e., a linear key receiving member or shape with a key in each end thereof, to drop through the bottom of the machine for collection and further use in assembling a frame. The cycle is repeated as long as key-receiving members or shapes are in the machine and keys or insertion members are in the magazines. The machine is readily adjustable for shapes of various lengths.

Referring now to the drawings and more particularly to FIG. 1, the novel machine or apparatus of the instant invention is illustrated generally at 10. The machine basically comprises a frame 20, a shape feed unit 30 mounted thereon, a shape stop unit 40 mounted on said frame, and a pair of key feed units 50 and 50' also mounted on said frame.

Figure 2:
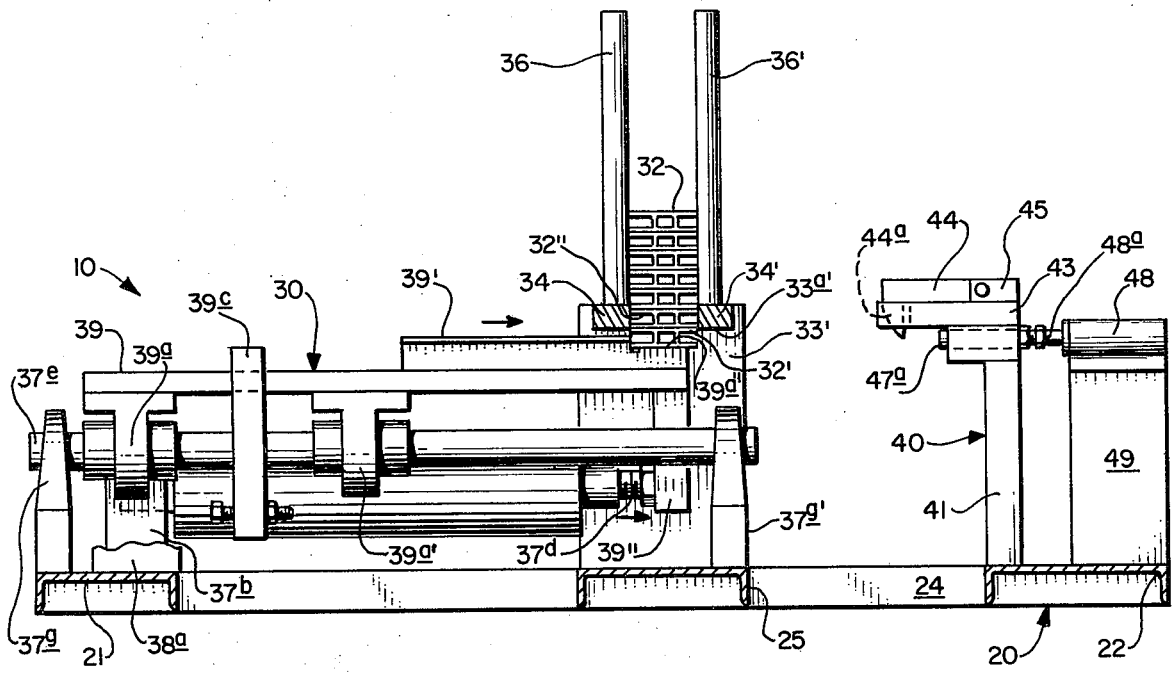
FIG. 2 is a somewhat enlarged partial sectional view along lines 2—2 of FIG. 1.
Figure 3:
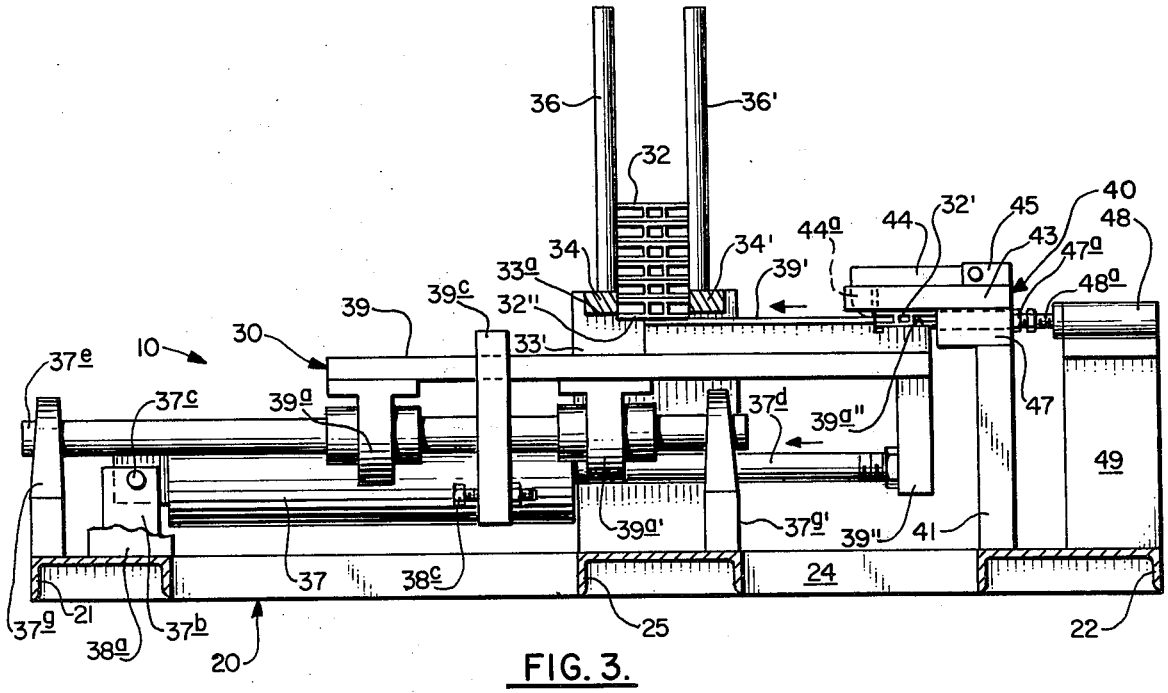
FIG. 3 is a view similar to FIG. 2, but illustrates the machine in forward motion.

The frame 20 is of generally rectangular construction and includes a pair of outside parallel metal channel or framing members 21 and 22 joined together by a pair of shorter outside parallel channel or framing members 23 and 24 (FIGS. 2 and 3). An intermediate metal channel frame member 25 extends parallel to the members 21 and 22 and somewhat nearer to frame member 22 and joins the members 23 and 24. Conveniently, additional framing members 26, 26', and 26'' (not seen) are positioned between the members 21 and 22 and perpendicular thereto and parallel to each other. Air control valves or solenoids 27 and 27' are conveniently mounted on the members 26 and 26', respectively, at a readily accessible location. Additional framing members can be employed as necessary or desired to provide suitable support for the apparatus 10 and its various components. A sufficient opening should be maintained between the framing members 22 and 25 to permit shapes of a desired length to easily pass or be dropped therethrough. The various frame members are connected together by welding, bolts, screws or any other suitable manner. Preferably, the frame is mounted on legs (not shown), a workbench, table or on any other suitable support means.

The shape feed unit 30 includes a shape support unit 31 which contains a plurality of shapes or lineal members 32. The support unit 31 includes a pair of support members 33 and 33' mounted on the frame member 25 perpendicular to said frame member and parallel to each other. The support members 33 and 33' are located a sufficient distance apart and on the frame member 25 so as to receive the shapes 32 perpendicularly therebetween. A pair of pick bars 34 and 34' are positioned in channels **33*a* and 33*a'* on the support members 33 and 33' in spaced apart parallel relationship to each other. The pick bars 34 and 34' are so spaced apart and located on the support members 33 and 33' and in relation to frame member 25, that a longitudinally extending opening is provided parallel to the pick bars 34 and 34' and therebetween. The opening is of a sufficient size to receive shapes 32. Pick bars 34 and 34' and supports 33 and 33' are preferably connected to their respective members by bolts or other suitable means so that they can be adjusted to accommodate shapes of various lengths. The pick bars 34 and 34' have a plurality of holes or openings 35 and 35', respectively, therein for receiving a plurality of guide or support rods 36 and 36'. The guide rods 36 extend vertically to a desired height and provide vertical support for a plurality of the shapes 32 and permit the shapes 32** to be stacked one upon the other therebetween.

Additionally, the shape feed unit includes an air cylinder 37 (FIGS. 2 and 3), air cylinder control valves 38 and 38', a shape feed mounting plate 39 and a shape feed slide plate 39' afixed to the shape feed mounting plate. The valve 27 permits air to be introduced or cut off to the air cylinder 37.

The air cylinder 37 is mounted on intermediate frame member 26'' (not seen) fastened perpendicularly to frame members 21 and 25 parallel to and between frame members 26 and 26''. Air cylinder 37 is mounted on the frame via a mounting plate **37*a* (not seen), a clevis 37*b* and a bolt 37*c*. Shaft 37*d* of the air cylinder 37 has a push block 39'' attached to the end thereof and perpendicularly joined to one end of the shape feed mounting plate 39 on the underside thereof. The mounting plate 39 is mounted on bearings 39*a*, 39*a'*, 39*b* and 39*b'*. The bearings are slidably mounted on shafts 37*e* and 37*f*. The shafts 37*e* and 37*f* are mounted to frame members 21 and 25 via shaft support members 37*g*, 37*h*, 37*g'* and 37*h'*. As can be seen in FIGS. 2 and 3, as the air cylinder shaft 37*d* is extended from its position as shown in FIG. 2 to its position as shown in FIG. 3, the mounting plate 39 and slide plate 39' thereon move with the shaft 37*d* towards a shape stop unit 40. The slide plate 39' has a recessed portion 39*a''* which contacts the shape 32' on the bottom of the stack of shapes 32 so that only the bottom shape is moved toward the shape stop unit 40. Pick bars 34 and 34' are so positioned above the slide plate 39' that after the bottommost shape 32' has been moved toward the stop unit 40, the second lowermost shape 32'' is held in position between the pick bars 34 and 34', thus enabling the slide plate 39' to return to its position shown in FIG. 2 from its position in FIG. 3.**

Valves 38 and 38' are attached to the frame member 21 by means of a mounting plate **38*a*. A valve actuating pin support member 39*c* is mounted on one side of the mounting plate 39 and has a pair of valve actuating pins or bolts 38*b* and 38*c* affixed therein adjacent to each other in a parallel relationship. Support member 39*c* and pins 38*b* and 38*c* therein move with the mounting plate 39 as the air cylinder shaft 37*d* moves from a closed position (FIG. 2) to an extended position (FIG. 3**).

The shape stop unit 40 includes a shape stop support 41 mounted on frame member 22 (FIG. 1). A top plate 43 is mounted on support member 41. A pair of picks or pick members 44 and 44' are mounted on the top plate 43 via pick brackets 45 and 45', respectively. The picks 44 and 44' are rotatably or pivotally mounted via pick pins 46 and 46', respectively, and rotate or pivot about the axis thereof. The top plate 43 has a pair of notches or openings **43*a* and 43*a'* for receiving the pick portions 44*a* and 44*a'*, respectively, of picks 44 and 44', respectively. A stop member 47 is mounted on the support member 41 and under the top plate 43. The stop member 47 has a stop pin 47*a* which extends therethrough for contacting a valve actuating pin or bolt 48*a* on a control valve 48. The valve 48 is mounted to the frame member 22 by means of a valve mounting member 49. Stop pin 47*a* is slidably mounted in stop member 47 and is so constructed therein by means of a spring device or other suitable means that its normal position is free of contact with valve actuating pin 48*a*. As the extrusion or shape 32' is forced against the stop pin 47*a* via slide plate 39', the stop pin 47*a* moves and contacts valve actuating pin 48*a* to actuate valve 48. The portions 44*a* and 44*a'* of picks 44 and 44', respectively, are so constructed that as the extrusion 32' is moved from the position shown in FIG. 2 to the position shown in FIG. 3, the picks 44 and 44' are raised, thereby enabling the extrusion 32' to pass under the top plate 43 so as to hit stop 47. When the slide plate 39' is in its outermost extended position, pick portions 44*a* and 44*a'* rest on the top of the slide plate 39' clear of the recessed portion 39*a''* therein. After corner keys are inserted in member 32' as will be explained hereinafter, the slide plate 39' is thus able to move back to its position shown in FIG. 2, since neither the picks 44 and 44' nor the shape 32'' retard its movement. As the slide plate 39' retracts, the pick portions 44** *a* and **44*a'* prevent the shape 32' from returning with the slide plate. Shape 32' then drops through the opening between frame members 22 and 25.**

As can readily be seen in FIG. 1, the stack of shapes 32 rest on the slide plate 39' on the plate 39.

Key feed units 50 and 50' are substantially identical, except one unit is adapted to position a corner key in one end of a shape, and the other unit is adapted to position a key member in the opposite end of the shape. Key feed units 50 and 50' are actuated by air cylinders 51 and 51', respectively. The air cylinders 51 and 51' are mounted on the movable plates 57 and 57', respectively, via clevises 52 and 52', which in turn are mounted on clevis support members 53 and 54' attached to the key feed movable plates 57 and 57', respectively. Air cylinder shafts 54 and 54' have push blocks 55 and 55' mounted on their respective ends. Push blocks 55 and 55' are also mounted on one end of and on the top side of key plates 56 and 56', respectively. Key plates 56 and 56' are slidably mounted on movable plates 57 and 57'. The key plates are attached to the movable plates via bearings 58, 59, 60 and 61 and bearings 58', 59', 60', and 61', which are slidably mounted on shafts 62 and 63 and shafts 62' and 63', respectively. The shafts are mounted to the movable plates via shaft support members 64, 65, 66, and 67 and shaft support members 64', 65', 66', and 67'. Key feed movable plates 57 and 57', are movably or slidably positioned on frame members 22 and 25 via a plurality of rollers 68 and 68', suitably located thereon. The movable plates permit the key feed units to be adjusted for various lengths or shapes. In order to lock the movable plates into position once a desired location has been selected, a plurality of holes 69 are located along one edge of the movable plates which can be aligned with corresponding holes along one edge of the frame member 22. To lock a movable plate in position, a pin 69*a* is inserted in an opening 69 which is aligned with a corresponding opening in the frame member 22.

The key units 50 and 50' also include key magazines 70 and 70' which may be loaded with a plurality of corner keys or angle members 71. The interior of the key magazine is so constructed as to position therein the type of key or angle member to be inserted in the end of a shape. The magazines 70 and 70' are mounted on the movable plates 57 and 57', respectively, by means of a pair of magazine support members 72 and 73 and a pair of magazine support members 72' and 73', respectively. Cross members 74 and 74' are mounted on support members 72 and 73 and 72' and 73', respectively. The key magazines 70 and 70' are mounted directly on such cross members. The cross members 74 and 74' have suitable openings therein so that keys 71 may be dropped therethrough to a key insertion position, which will be explained more fully hereinafter.

Valves 80 and 80' are mounted on the key plates 57 and 57', respectively, by means of valve support members 81 and 81', respectively. Valves 80 and 80' have actuating pins 80*a* and 80*a'*, respectively, positioned therein. Valve actuating pin support members 81'' and 81''' are mounted on the edges of key plates 56 and 56', respectively, so as to move therewith by means of bolts or other suitable means. A pair of valve actuating pins 81*a* and 81*b* and 81*a'* and 81*b'* are fixedly secured in support members 81 and 81'. Pins 81*a* and 81*b* are parallel and adjacent each other, as are pins 81*a'* and 81*b'*. Pins 81*b* and 81*b'* extend through each side of their respective support members 81'' and 81'''. Valves 82 and 83, and 82' and 83' are mounted on movable plates 57 and 57', respectively, via mounting support members 73 and 73', respectively. Each valve has a valve control pin therein for causing the air cylinders to be actuated to move their shafts either forward or backward. Pins 82*a*, 83*a*, 82*a'* and 83*a'* are located in valves 82, 83, 82' and 83', respectively.

The pins 82*a* and 83*a* are aligned with bolts 81*b* and 81*a*, respectively, so as to make contact therewith each other when moved into a contacting position. Similarly, the pins 82'*a* and 83'*a* are aligned with bolts 81'*b* and 81'*a*, respectively.

Figure 4:
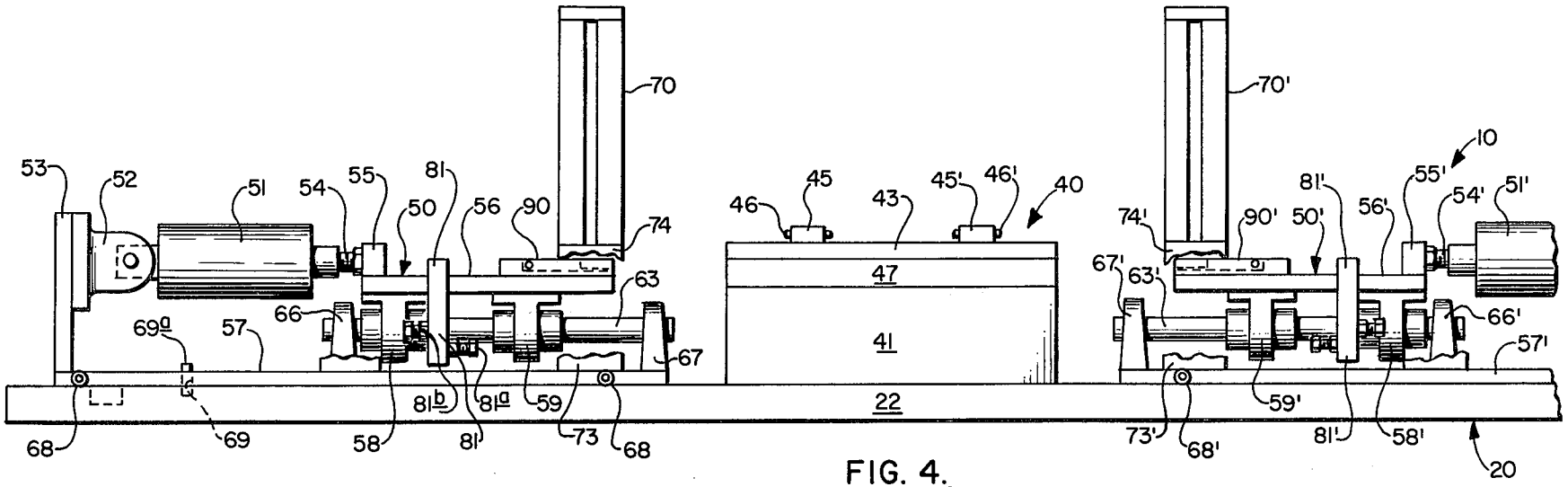
FIG. 4 is a front elevation illustrating the machine of the instant invention.
Figure 5:
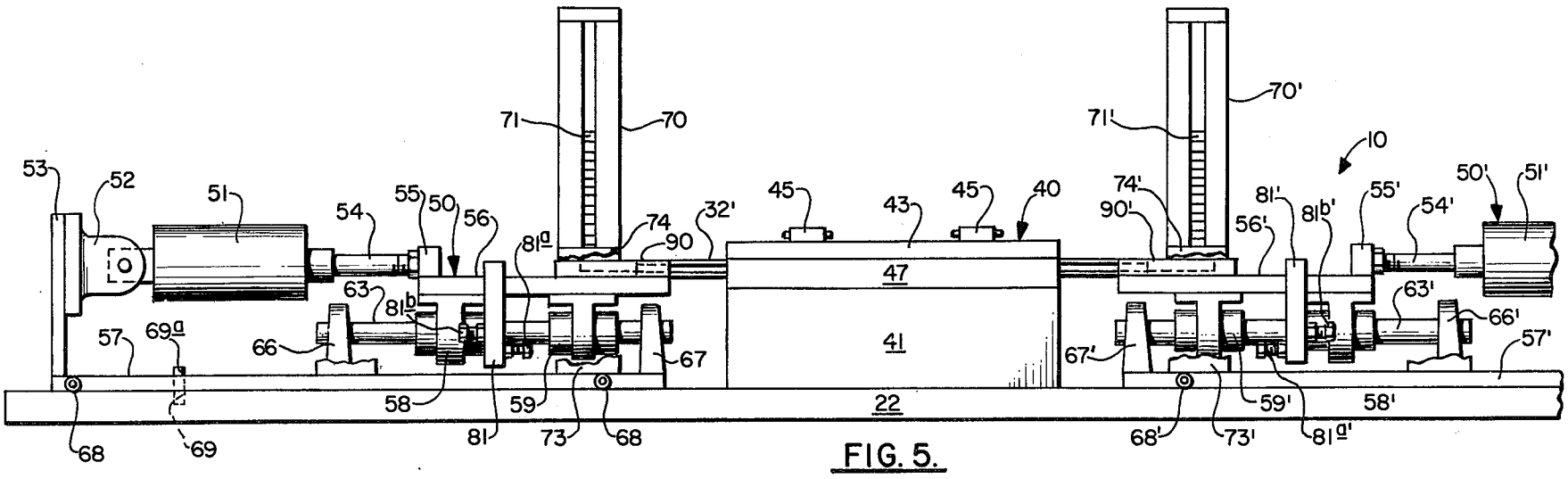
FIG. 5 is a view similar to FIG. 4 but shows a plurality of corner keys being inserted in a metal member.
Figure 6:
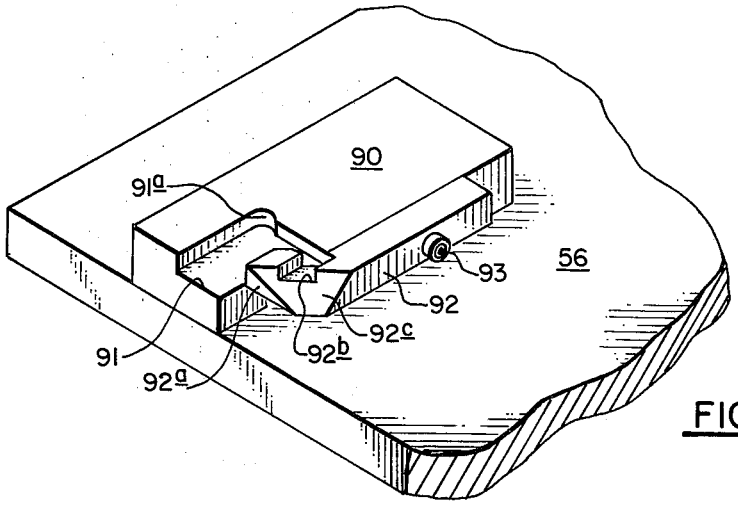
FIG. 6 is a partial perspective view of the key holder just prior to receiving a corner key.
Figure 7:
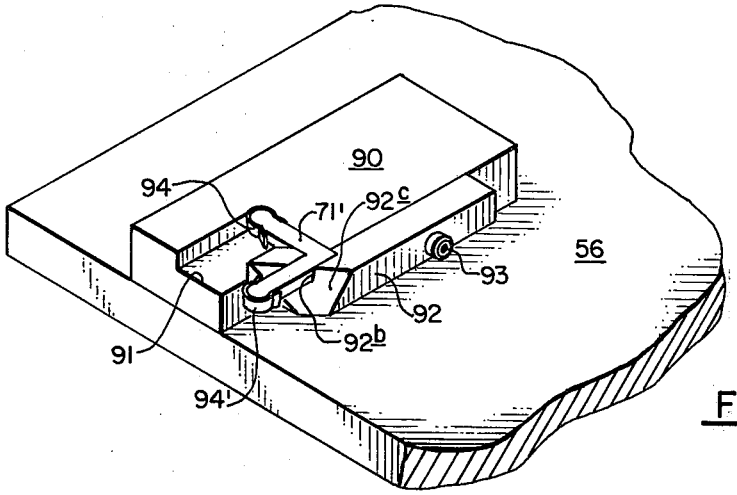
FIG. 7 is a view similar to FIG. 6, but illustrates such key holder with a key in position therein.
Figure 8:
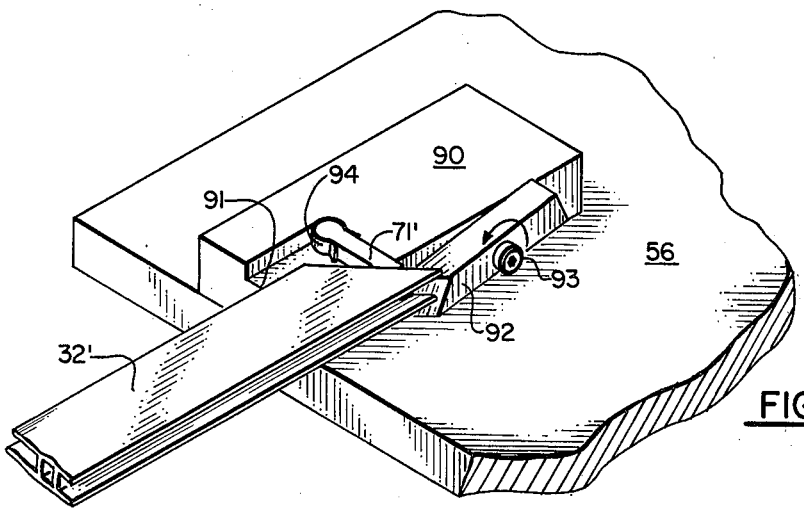
FIG. 8 is a view similar to FIG. 7 and illustrates the insertion of a corner key in a metal extrusion member.

As seen in FIGS. 1, 4, and 5 and in more detail in FIGS. 6, 7, and 8, key push blocks 90 and 90' are mounted on each end of the key plates 56 and 56', respectively. Push blocks 90 and 90' have recessed portions 91 and 91', respectively, on one end thereof. A key pivot or key pivot member 92 and 92' is pivotally attached to one side of push blocks 90 and 90', respectively, by means of pivot pins 93 and 93', respectively. Pivots 92 and 92' have somewhat L-shaped key receiving parts 92*a* and 92*a'*, respectively, on one end thereof. End parts 92*a* and 92*a'* have channels or notches 92*b* and 92*b'*, respectively, on the top thereof so constructed as to receive keys 71' and 71''', respectively (See FIGS. 6 and 7). One face 92*c* of end part 92*a* and one face 92*c'* of end part 92*a'* is somewhat angularly disposed and is so constructed that as the push blocks are moved toward shape 32', the pivot members 92 and 92' are pivoted outwardly from their respective push blocks and permit keys 71' and 71'' to be inserted the maximum distance into the openings in each end of the shape 32' (See FIG. 8).

Each of the keys 71 has rounded ends with a similarly rounded clip on each end thereof. As best seen in FIGS. 7 and 8, key member 71' has clips 94 and 94' on each end thereof. Recessed portion 91 of push block 90 has a rounded opening or part 91*a* (FIG. 6) adapted to receive the rounded end of key 71' and clip 94 thereon.

After shape or extrusion 32' actuates valve 48, as explained hereinbefore, valve 48 actuates the key feed units 50 and 50' as will be further explained hereinafter. Just prior to actuation, the key feed units operate from their positions as shown in FIG. 4 to their respective positions as shown in FIG. 5. As air cylinders 51 and 51' are actuated, their respective shafts 54 and 54' are caused to extend. This causes key plates 56 and 56' to move with the air cylinder shafts and the push blocks 90 and 90' on said key plates force keys 71' and 71'' into the openings in each end of shape 32'. When the air cylinder shafts have reached their extended position, valves 82, 83 and 82', 83' are actuated which causes the key feed units to retract from their FIG. 5 position to their FIG. 4 position. The key plate push blocks slide under the keys stacked in the two key magazines, and when they are retracted to their FIG. 4 (also FIG. 1) position, the bottommost key in each stack falls into the position as shown in FIG. 7. The key feed cycle is then repeated. A key plate push block, key feed magazine and parts thereof are so constructed that only one key at a time is picked up by the push block and the push block is free to move back and forth from a non-extended position to an extended position without being inhibited by the remaining keys. The keys in a stack of keys in a magazine rest on the top of a push block and the push block slides under the stack of keys remaining after a key has been moved to an insertion position.

Although the apparatus is illustrated with two key feed mechanisms for simultaneously inserting a key in each end of a lineal member or shape having openings in the ends thereof suitable for receiving the keys, the apparatus can be operated with a single key feed device, if desired. Of course, the use of only one key feed device would not be as efficient as using two such devices.

Although the particular concept of the invention illustrated is adapted for use with a particular type of corner key or angle member, the invention is readily adaptable for use with other types of angle members or corner keys or even with other types of members suitable for insertion in an opening in the end of a lineal member or shape.

Although the invention as shown in the drawings is directed to the use of mitered aluminum extrusions suitable for use in constructing window frames, it can readily be appreciated that other types of shapes or lineal members can be used. The lineal members can be made of wood, metal, plastic or any other suitable materials in which member it is desired to insert a key or similar member in an end thereof. All that is necessary is that suitable insert receiving openings be constructed in the ends of the lineal members for which a key or other insert member is to be inserted.

Although the apparatus of the present invention is illustrated as being pneumatically operated or controlled, it can readily be appreciated that such apparatus can be operated electrically via suitable switches and solenoids, hydraulically via suitable valves and/or switches, by various combinations of electrical means, hydraulic means and pneumatic means, and even by hand, if so desired.

In the operation of the machine or novel apparatus, an air supply source and a main control valve for cutting on and off the air to the air circuits are provided. To commence operation after loading the shape feed support unit and the key magazines, the main control valve is opened. This causes the shape feed air cylinder to actuate and extend the air cylinder shaft. This moves the slide plate towards the stop unit. The slide plate picks or catches the bottom shape and slides it over until it hits the stop. When the shape hits the stop, it actuates a second valve. This second valve causes the key feed units to actuate and the air cylinder shafts to extend, thus moving the push blocks toward the shape in position at the stop unit. The bottom key in each stack is pushed into the openings in the ends of the shape at the stop position. After the keys are inserted in the ends of the shape, valve actuating pins actuate the key feed valves causing the key feed air cylinder shafts to retract and the key plates attached thereto to move away from the key magazines, leaving the keys in the shape. When the key plate is fully retracted, additional air valves are actuated by valve actuating pins which cause the shape feed unit to retract. The shape feed plate then moves back to its original position. As the shape feed plate retracts, the shape with keys therein drops through the opening between the frame members 22 and 25 for further use. When the shape feed plate is fully retracted, another valve actuating pin actuates the shape feed air cylinder, extends the shape feed air cylinder shaft, moves the shape feed plate toward the stop, and picks the bottom shape out from under the stack, continuing the cycle. Once the main control valve is opened, the cycle continues as long as shapes are in the shape support unit.

Figure 9:
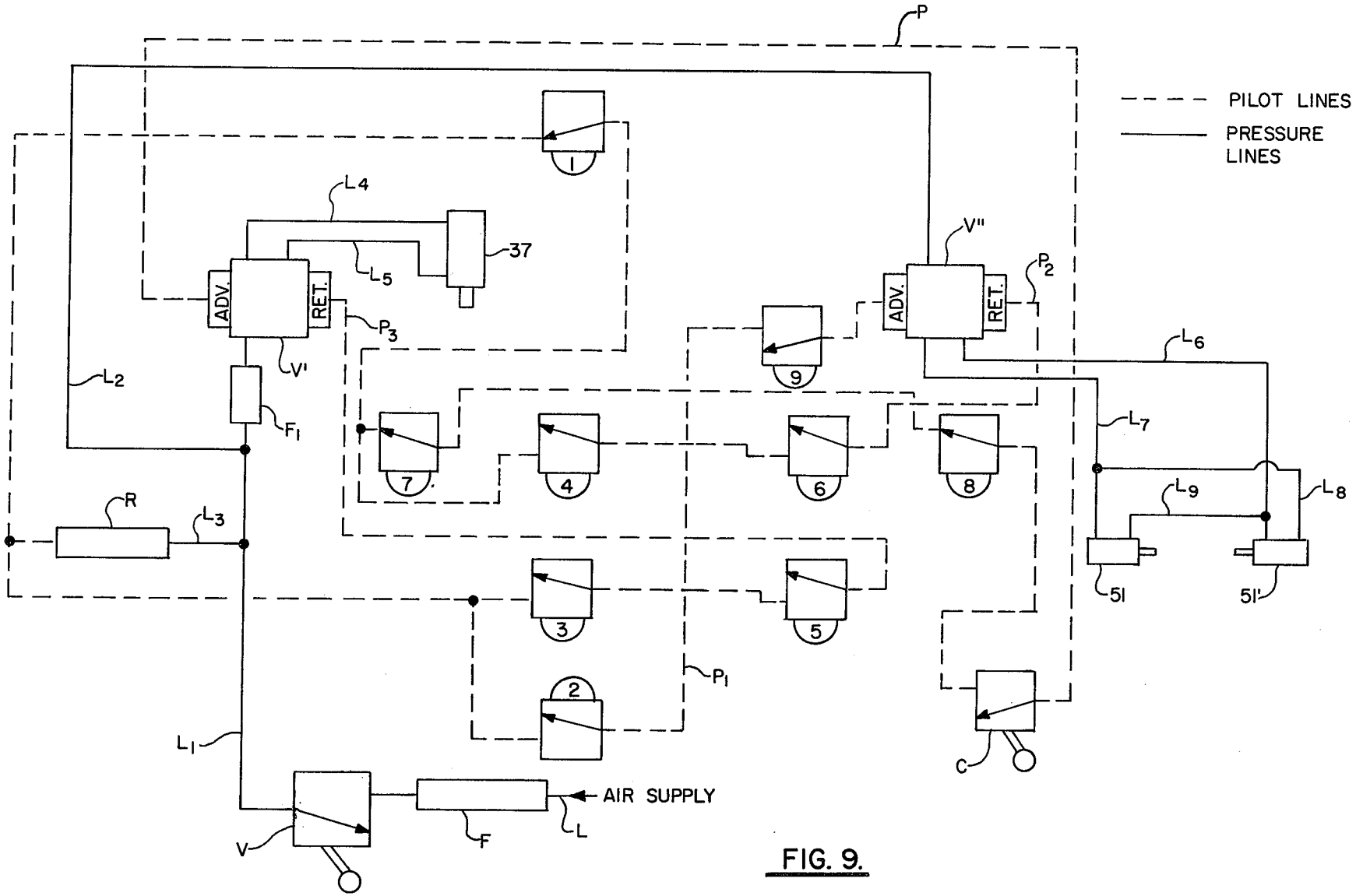
FIG. 9 is a schematic view of the air pressure lines, pilot lines and valves illustrating the operating means for the machine.

The sequence of operation is explained in more detail hereinafter. Referring to the schemtic drawing of FIG. 9 and to FIG. 1, wherein the various valves are similarly identified, main air lines, pilot lines and valves are connected to a main air supply valve V conveniently located on frame member 22 (or any other suitable location). The main valve V is connected to a suitable air supply source via main air line L. Preferably, an air filter, regulator and lubricator F is positioned in the line L between the air supply source and valve V. In the machine illustrated, about 120 p.s.i. air pressure is maintained in the line L as about 100 p.s.i. is necessary to insert the key members in the shapes. An air pressure of about 2–10 p.s.i. is maintained in the pilot lines. The air pressure may, of course, be regulated as needed or desired.

Opening the main air supply valve V sends air through a line $L_1$ and thus to shape feed unit valve V′ through an air regulator and lubricator $F_1$ in line $L_1$ and through a line $L_2$ to key feed unit valve V″. Valve V′ is conveniently mounted on frame member 26 (or any other suitable location). Valve V″ is conveniently mounted on frame member 26″ (or any other suitable location). Valves V′ and V″ are activated causing the shape feed air cylinder 37 to retract and key feed air cylinders 51 and 51′ to retract. Air pressure to the pilot lines and additional control valves is reduced by a regulator, lubricator R in line $L_3$ extending from line $L_1$. Air cylinder 37 is connected to valve V′ by lines $L_4$ and $L_5$ and air cylinders 51 and 51′ are connected to valve V″ by lines $L_6$, $L_7$, $L_8$, and $L_9$. As shape feed air cylinder 37 and shape feed unit are retracted, valves 1 and 9 are actuated. As key feed air cylinders 50 and 50′ and their respective key feed units are retracted, valves 7 and 8 are actuated.

Actuating a cycle start-stop valve C, conveniently mounted on frame member 22 (or any other suitable location) allows pilot air pressure via line P to enter the advance side of shape feed valve V′ which in turn allows air to go to shape feed air cylinder 37 causing it to extend or advance the shape feed unit to pick a shape from the bottom of the stack of shapes. When the shape feed air cylinder 37 is fully extended, valve 2 is actuated. (Valves 1 and 9 are released as the shape feed begins). Valve 2 causes pilot air to go to the advance side of key feed valve V″ via line $P_1$, which in turn causes air to go through the valve V″ to extend the key feed air cylinders 51 and 51′. After the key feed units have picked a key from the bottom of their respective magazines and inserted the keys in the ends of the shape, valves 3, 4, 5 and 6 are actuated. (Valves 7 and 8 are released when key feed begins.) Actuation of valves 3, 4, 5, and 6 causes the pilot air to be routed to the retract side of the key feed valve via line $P_2$ which in turn causes air to go through valve V″ causing the two key feed cylinders 51 and 51′ to retract. (Valves 3, 4, 5, and 6 are released when the key feed units begin retracting.) After the key feed units are completely retracted, valves 7 and 8 are actuated causing pilot air to flow to the retract side of shape feed valve V′ via line $P_3$. This allows air to go through the valve V′ and causes the shape feed cylinder 37 to retract. (Valve 2 is released when the shape feed unit begins retracting.) The shape feed cylinder 37 actuates valves 1 and 9 when it is completely retracted. This causes pilot air to be routed to the advance side of shape feed valve V′ via line P beginning the entire operation again.

As previously stated, the complete cycle will continue as long as shapes are in the shape feed unit. Closing the cycle start-stop valve C causes the machine to stop after the cycle is completed. Closing the main supply valve V causes the machine to stop since no air flow is present.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. An apparatus for inserting a key member in an opening in a lineal member or shape comprising a frame, and mounted on said frame, a shape feed means for moving the shape to a preset location for receiving the key member, shape stop means for stopping the shape at the preset location for receiving the key member, and key feed means for inserting the key member in the lineal member or shape, said shape feed means including a shape support unit, and said shape support unit including shape support means, shape pick bar means mounted thereon and shape guide means mounted on said pick bar means.

2. The apparatus of claim 1, including means for actuating said shape feed means and said key feed means in a preset continuing sequence.

3. The apparatus of claim 2, wherein said actuating means comprises a plurality of air cylinders having air cylinder shafts therein and a plurality of air cylinder control valves.

4. The apparatus of claim 1, including at least two key feed means, whereby a key member can be inserted in each end of the lineal member, simultaneously.

5. The apparatus of claim 1, wherein said shape feed means includes a movable slide plate means having a recessed portion therein for contacting an edge of a shape and means for moving said movable slide plate into contact with said shape, picking up or catching said shape and sliding said shape to contact said shape stop means.

6. The apparatus of claim 1, wherein said shape stop means includes a shape stop support means, a shape stop plate means mounted thereon, shape stop pick means pivotally mounted on said shape stop plate means and a shape stop member.

7. The apparatus of claim 6, wherein said shape stop member includes a means thereon for actuating the key feed means.

8. The apparatus of claim 1, wherein said key feed means includes a movable plate, a key plate slidably mounted on said movable plate and means for moving said key plate into contact with a key and inserting the key into an opening in the end of the shape.

9. An apparatus for inserting a key or the like in an opening in the end of a lineal member or shape comprising a frame, and mounted on said frame, a shape feed means, a shape stop and a key feed means; said shape feed means including a movable slide plate means, shape pick means on said slide plate means for catching a shape, and means for moving said slide plate into contact with said shape so as to catch said shape and move said shape to contact said shape stop means; said shape feed means also including shape support means for positioning and supporting a plurality of shapes stacked one upon the other in vertical alignment and means for enabling only the bottommost shape to be caught by said slide plate pick means so that only said bottommost shape is moved into contact with said shape stop means; said key feed means, including a movable plate means, a key plate means slidably mounted thereon, means on said key plate for contacting a key and inserting said key in an opening in the end of said shape, and means for moving said key plate; said key feed means also including a key support means for positioning and supporting a plurality of keys stacked one upon the other in vertical alignment and means for enabling only the bottommost key to be inserted in the opening in the end of said shape.

10. The apparatus of claim 9, including means for operating said shape feed means, said stop means and said key feed means in predetermined or preset sequence and continuing said sequence of operation in a continuous cycle.

11. The apparatus of claim 9, including a key feed means on said frame for each end of said lineal member whereby keys may be inserted in each end of said lineal member, simultaneously.

12. The apparatus of claim 9, wherein said shape stop means includes means thereon for actuating said key feed means.

13. The apparatus of claim 9, wherein said shape stop means includes a shape stop support means, a shape stop plate means mounted thereon, a shape stop pick means pivotally mounted on said shape stop plate means and a shape stop member for stopping said shape at a desired position.

14. The apparatus of claim 9, wherein said means for moving said slide plate means includes an air cylinder and an air cylinder shaft and said means for moving said key plate means includes an air cylinder and an air cylinder shaft, and a plurality of valves for directing air to said air cylinders in a preset sequence.

15. An apparatus for inserting an insert member in an opening in the end of a lineal member or shape having an opening in an end thereof for receiving said insert member, comprising a frame, and mounted on said frame, a means for positioning a plurality of said shapes on said apparatus, means for selecting one of said shapes and moving said one of said shapes to a preset location for receiving said insert member, means for positioning a plurality of said insert members on said apparatus, means for selecting one of said insert members and moving said one of said insert members into an insertion position in an opening in the end of said one of said shapes, and said means for positioning a plurality of said shapes on said apparatus including a shape support means, shape pick bar means mounted thereon and shape guide means mounted on said pick bar means.

16. The apparatus of claim 15, including means for operating said shape selecting and moving means and said insert member selecting and moving means in a predetermined sequence of operation.

17. The apparatus of claim 15, including means for pneumatically operating said shape selecting and moving means and said insert member selecting and moving means in a predetermined sequence of operation.

18. The apparatus of claim 15, including two means for positioning a plurality of said insert members on said apparatus and a means for selecting one of said insert members from each of said insert member positioning means and moving each of said insert members simultaneously into an opening in each end of said one of said shapes.

* * * * *

UNITED STATES PATENT OFFICE

CERTIFICATE OF CORRECTION

PATENT NO. : 3,965,560

DATED : June 29, 1976

INVENTOR(S) : James C. Jackson

It is certified that error appears in the above-identified patent and that said Letters Patent are hereby corrected as shown below:

Assignee should read -- Ethyl Corporation, Richmond, Virginia --. Column 6, line 15, " 71''' ", should read -- 71'' --.

Signed and Sealed this

First Day of March 1977

[SEAL]

*Attest:*

RUTH C. MASON
*Attesting Officer*

C. MARSHALL DANN
*Commissioner of Patents and Trademarks*